US009097145B2

(12) United States Patent
Hwang et al.

(10) Patent No.: US 9,097,145 B2
(45) Date of Patent: Aug. 4, 2015

(54) CONTINUOUSLY VARIABLE VALVE LIFT ACTUATOR OF ENGINE

(71) Applicant: MOTONIC CORPORATION, Seoul (KR)

(72) Inventors: Soo Hyun Hwang, Daegu (KR); Jin Hwan Jeon, Daegu (KR); Jong Wung Park, Daegu (KR); Hee Dong Eom, Daegu (KR); Dong Il Kim, Daegu (KR)

(73) Assignee: MOTONIC CORPORATION, Seoul (KR)

( * ) Notice: Subject to any disclaimer, the term of this patent is extended or adjusted under 35 U.S.C. 154(b) by 0 days.

(21) Appl. No.: 14/085,409

(22) Filed: Nov. 20, 2013

(65) Prior Publication Data

US 2015/0059673 A1 Mar. 5, 2015

(30) Foreign Application Priority Data

Aug. 29, 2013 (KR) ..... 10-2013-0102943
Oct. 14, 2013 (KR) ..... 10-2013-0122063

(51) Int. Cl.
*F01L 1/18* (2006.01)

(52) U.S. Cl.
CPC ... *F01L 1/185* (2013.01); *F01L 1/18* (2013.01)

(58) Field of Classification Search
CPC ..... F01L 1/18; F01L 1/185
USPC ..... 123/90.39, 90.44; 74/569
See application file for complete search history.

(56) References Cited

U.S. PATENT DOCUMENTS 7,556,003 B2 * 7/2009 Fujii et al. ..... 123/90.39
8,360,021 B2 * 1/2013 Toda et al. ..... 123/90.17

FOREIGN PATENT DOCUMENTS

KR 10-1084739 B1 11/2011
KR 10-1084741 B1 11/2011
KR 10-2012-0088363 A 8/2012
KR 10-2013-0063344 A 6/2013

* cited by examiner

*Primary Examiner* — Ching Chang
(74) *Attorney, Agent, or Firm* — Novick, Kim & Lee, PLLC; Jae Youn Kim

(57) ABSTRACT

Disclosed is a continuously variable valve lift actuator of an engine. The continuously variable valve lift actuator of an engine changes rotating angles of a rocker arm and a lift arm having a four-bar link structure to control an intake amount of air of an intake valve based on a running state of a vehicle, and adjusts a location and a length of a link bar by taking into consideration a rotating direction of a cam shaft and interference according to layout of the engine to advance an open time of a valve. The continuously variable valve lift actuator of an engine can reduce pumping loss by controlling an intake amount of air by changing an elevating distance of a valve according to a running state of a vehicle, and the fuel efficiency and the efficiency of the engine can be improved by advancing the open time of the valve.

8 Claims, 15 Drawing Sheets

"Prior Art"

CONTINUOUSLY VARIABLE VALVE LIFT ACTUATOR OF ENGINE

BACKGROUND OF THE INVENTION

1. Field of the Invention

The present invention relates to a continuously variable valve lift actuator of an engine, and more particularly to a continuously variable valve lift actuator of an engine to control a lift amount of a valve according to operational conditions of a vehicle.

2. Description of the Related Art

A valve device applied to an engine of a vehicle supplies a mixed gas into a combustion chamber and exhausts a combustion gas according to strokes of the engine.

Recently, variable valve devices, which optimize an inflow amount of the mixed gas and an exhaust efficiency of the combustion gas by changing an open degree and an opening/closing time of a valve according to operational conditions, that is, an operational region of the engine divided by revolutions per minute (hereinafter, referred to as 'RPM') and a load of the engine, have been developed and applied to the engine.

Accordingly, the variable valve device of an engine for a vehicle may improve a performance of the engine such as fuel efficiency, a torque, and an output of the engine and reduce an amount of an exhaust gas.

The variable valve device of an engine for a vehicle includes a variable valve timing unit to change an opening/closing time of a valve, a variable valve lift unit to change an open degree of the valve, and a variable valve actuation angle unit to change an actuation angle of the valve.

Among the above units, the variable valve timing unit improves an output and a fuel efficiency in a middle/low speed mode, and is divided into a rocker arm type, a pivot type, a tappet type, and a bucket type.

The applicant of the present invention has filed a technology regarding a variable valve lift device as Korean Patent No. 10-1084739 issued on Nov. 22, 2011, Korean Patent No. 10-1084741 issued on Nov. 22, 2011, and Korean Unexamined Patent Publication No. 10-2012-0088363 published on Aug. 8, 2012.

However, when the continuously variable valve lift actuator according to the related art is applied to a vehicle, pumping loss is increased because a throttle body sucks air upon an intake stroke.

Therefore, there is a need for development of a technology capable of reducing the pumping loss by controlling a suction amount of air by an intake valve of an input port of a cylinder by improving a structure of the continuously variable valve lift actuator applied to a gasoline engine.

Further, there is a demand for development a technology to improve a fuel efficiency and an output of a vehicle by controlling an intake amount of air in an operation state, that is, a high speed operation state or a low speed operation state of the vehicle.

In addition, the continuously variable valve lift actuator of an engine according to the related art needs a process of controlling valve clearance in a state that the continuously variable valve lift actuator is mounted in the engine.

In this manner, according to the related art, since the control operation is performed in a state that the continuously variable valve lift actuator is mounted in the engine, if the control of the valve clearance fails, it is necessary to perform the control operation by replacing the continuously variable valve lift actuator with new one after separating the continuously variable valve lift actuator from the engine.

Accordingly, productivity of the engine and the quality of a product are degraded when using the continuously variable valve lift actuator of the engine according to the related art.

SUMMARY OF THE INVENTION

Accordingly, the present invention has been made keeping in mind the above problems occurring in the prior art, and an object of the present invention is to provide a continuously variable valve lift actuator of an engine to minimize pumping loss by controlling an intake amount of air by an intake valve at an input port of a cylinder.

It is another object of the present invention to provide a continuously variable valve lift actuator of an engine capable of controlling an intake amount of air according to operational conditions of a vehicle.

It is still another object of the present invention to provide a continuously variable valve lift actuator of an engine capable of controlling a valve lift deviation between cylinders during a process of manufacturing and assembling the continuously variable valve lift actuator of the engine.

It is yet another object of the present invention to provide a continuously variable valve lift actuator of an engine capable of improving a fuel efficiency and an efficiency of the engine by advancing an open time of a valve.

According to an aspect of the present invention, there is provided a continuously variable valve lift actuator of an engine, which changes rotating angles of a rocker arm and a lift arm having a four-bar link structure to control an intake amount of air of an intake valve based on a running state of a vehicle, and adjusts a location and a length of a link bar by taking into consideration a rotating direction of a cam shaft and interference according to layout of the engine to advance an open time of a valve.

The rocker arm may be rotated within a preset angle range according to a rotational motion of a pair of eccentric cams coupled to a control shaft and a rotation motion of a cam coupled to a cam shaft, and a pair of lift arms having one side coupled to a control shaft may be rotated within a preset angle range, wherein a pair of flanges and a pair of coupling flanges spaced apart from each flange by a predetermined angle may be provided at both ends of the rocker arm in a direction perpendicular to a central axis of the rocker arm, respectively, and the coupling flanges and the lift arms may be rotatably connected to each other by lift arm links, respectively.

Coupling holes may be formed at centers of the flanges, respectively, and a rocker arm axle is coupled in the coupling holes, the rocker arm axle may be coupled into the coupling holes of each flange by passing through the coupling holes, a bearing making contact with the cam may be coupled with a central portion of the rocker arm axle, a coupling hole may be formed at a central portion of the lift arm so that the control shaft is coupled into the coupling hole, and a curved surface to control a lift amount of a valve may be formed at a bottom surface of the lift arm.

The continuously variable valve lift actuator may further include a deviation control part to control lift deviation between valves by controlling rotating angles of the rocker arm and the lift arm, wherein the deviation control part may include a pair of adjusting screws coupled with an insertion hole of each coupling flange and a cylindrical portion of the lift arm link provided at both ends of the rocker arm, respectively, and a pair of fixing nuts fastened to a front end of each adjusting screw.

A pair of return springs may be provided at outer sides of the lift arms through the control shaft to provide a restoring force to the lift arms.

A contact projection may be formed at a front surface of the lift arm, and a return spring making contact with a lower portion of the contact projection may be provided at a carrier, on which the continuously variable valve lift actuator of the engine is installed, to provide the restoring force to the lift arm.

A control groove may be formed at a head of each adjusting screw, a tool is inserted into the control groove to adjust a rotating angle of the adjusting screw, and scales are notched in the head of the adjusting screw at a predetermined interval to confirm an adjusting amount when adjusting lift deviation of the valve.

The cam may be rotated clockwise in a high lift mode, the control shaft is rotated clockwise to ascend lift arm so that the high lift mode is switched to a low lift mode, and a position of a contact point between a roller of the rocker arm and a cam descends based on a center of the cam so that an advance effect is presented.

As described above, according to the continuously variable valve lift actuator of an engine of the present invention, an intake amount of air can be precisely controlled by changing an elevating distance of a valve according to a running state of a vehicle.

Further, according to the present invention, when valve lift deviation between cylinders of the engine occurs, the valve lift deviation between cylinders of the engine can be controlled by controlling a rotating angle between the rocker arm and the lift arm using a deviation controller.

Moreover, the present invention can be applied to various engines to advance the open time of a valve by controlling a location and a length of a link bar according to a rotating direction of a cam shaft to an intake valve of the engine and interference of a layout of the engine to obtain an open time of the valve in the high lift mode or the low lift mode.

In addition, according to the present invention, the open time of the valve can advance in the high lift mode or the low lift mode by changing a position of a point B in the continuously variable valve lift actuator of an engine having a four-bar link structure.

As a result, according to the present invention, the intake amount of air to be supplied to the engine can be precisely controlled according to a running state of the vehicle by exactly controlling valve lift deviation between cylinders, and the fuel efficiency and the efficiency of the engine can be improved by advancing the open time of the valve.

DETAILED DESCRIPTION OF THE INVENTION

Hereinafter, the continuously variable valve lift actuator of an engine according to an exemplary embodiment of the present invention will be described in detail with reference to the accompanying drawings.

Unlike the continuously variable valve lift actuator of an engine having a dual four-bar link structure according to the related art, the continuously variable valve lift actuator of an engine according to the present invention has a four-bar link structure and adjusts a location and a length of a link bar by taking into consideration a rotating direction of a cam shaft and interference according to layout of the engine to advance an open time of a valve.

Therefore, according to the present invention, a work time and a cost can be reduced upon manufacture and a fuel efficiency and an efficiency of the engine can be improved by simplifying a configuration of the continuously variable valve lift actuator of an engine.

Hereinafter, the continuously variable valve lift actuator of an engine with a four-bar link structure according to an exemplary embodiment of the present invention will be described in detail.

Figure 1:
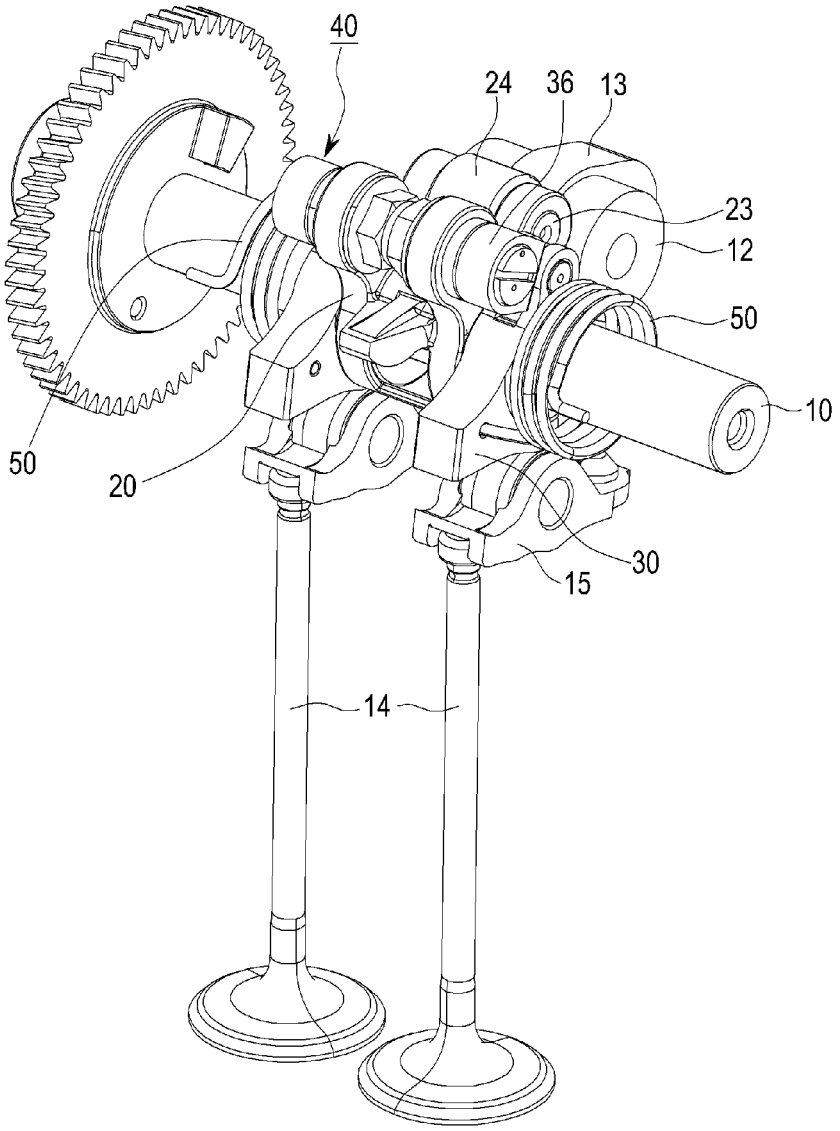
FIG. 1 is a perspective view illustrating a continuously variable valve lift actuator of an engine according to an exemplary embodiment of the present invention.
Figure 2:
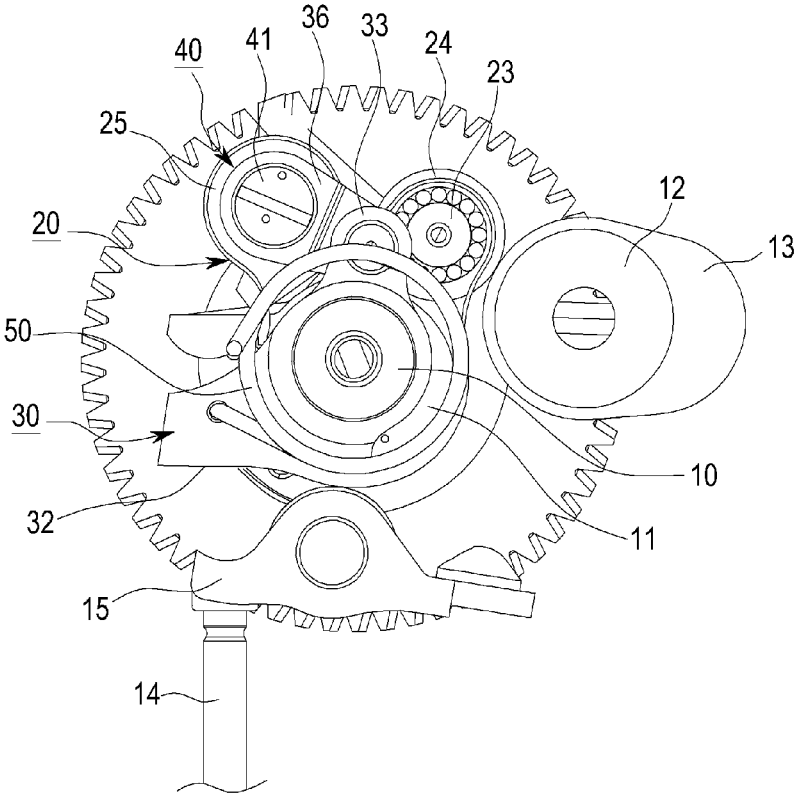
FIG. 2 is a side view illustrating the continuously variable valve lift actuator of an engine shown in FIG. 1.
Figure 3:
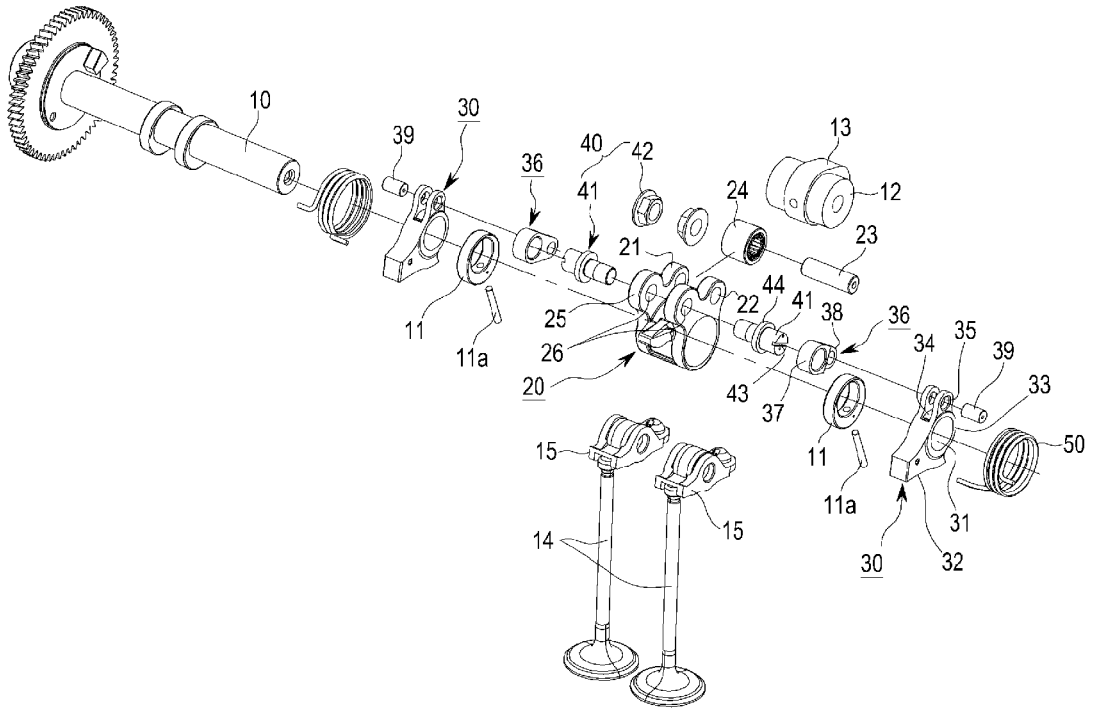
FIG. 3 is an exploded perspective view illustrating continuously variable valve lift actuator of an engine shown in FIG. 1.

FIG. 1 is a perspective view illustrating a continuously variable valve lift actuator of an engine according to an exemplary embodiment of the present invention, FIG. 2 is a side view illustrating the continuously variable valve lift actuator of an engine shown in FIG. 1, and FIG. 3 is an exploded perspective view illustrating continuously variable valve lift actuator of an engine shown in FIG. 1.

In drawings, an 'F' signifies a 'forward direction', a 'B' signifies a 'backward direction', a 'U' signifies an 'upward direction', a 'D' signifies a 'downward direction', an 'L' signifies a 'left side', and an 'R' signifies a 'right side'.

As shown in FIGS. 1 to 3, the continuously variable valve lift actuator of an engine according to an exemplary embodiment of the present invention includes a rocker arm rotated within a preset angle range according to a rotational motion of a pair of eccentric cams coupled to a control shaft 10 and a rotation motion of a cam 13 coupled to a cam shaft 12, and a pair of lift arms 30 having one side coupled to a control shaft 10 and rotated within a preset angle range.

Further, the continuously variable valve lift actuator of an engine may include a deviation control part 40 to control lift deviation between valves by controlling rotating angles of the rocker arm 20 and the lift arm 30.

As shown in FIGS. 2 and 3, an installation hole is formed at a center of the rocker arm 20 so that a control shaft 10 is coupled and has a substantially cylindrical shape.

A pair of flanges 21 and a pair of coupling flanges 25 spaced apart from each flange by a predetermined angle are provided at both ends of the rocker arm 20 in a direction perpendicular to a central axis of the rocker arm 20, respectively.

Coupling holes 22 may be formed at centers of the flanges 21, respectively, and a rocker arm axle 23 is coupled in the coupling holes 22.

The rocker arm axle 23 is coupled into a coupling hole 22 of each flange 21 formed at both ends of the rocker arm 20 by passing through the coupling holes 22 and the bearing 24 making contact with a cam 13 may be coupled with a central portion of the rocker arm axle 23.

The bearing 24 makes contact with an outer peripheral surface of the cam 13 provided at the cam shaft 12, and serves to transfer a rotational motion of the cam 13 to the rocker arm 20 through the rocker arm axle 23.

A pair of coupling flanges 25 constitute the deviation control part 40 together with an adjusting screw 41 and a fixing nut 42 which will be described later.

To this end, an insertion hole 26 in which the adjusting screw 41 is inserted may be formed at each coupling flange 25.

In addition, the coupling flange 25 serves to transfer a rotational motion of the rocker arm 20 to the lift arm 30 through a lift arm link 36.

A configuration of the deviation control part 40 will be described in detail with reference to FIG. 3.

The control shaft 10 performs a rotational motion according to a rotating operation of a drive motor (not shown) in order to control an intake amount of air according to an operational state of the vehicle.

To this end, a controller (not shown) of the vehicle generates a control signal to control drive of the drive motor so as to implement a high lift mode to increase an intake amount of air upon a low speed operation of the vehicle and a low lift mode to reduce the intake amount of air upon a low speed operation of the vehicle.

The drive motor performs a rotational motion at a preset angle according to the control signal from the controller.

The rocker arm 20 is coupled with a central portion of the control shaft 10, and an eccentric cam 11 and a lift arm 20 may be coupled to both sides of the rocker arm 20.

The eccentric cam 11 is coupled with the control shaft 10 so that the eccentric cam 11 is rotated by a preset angle according to a rotational motion of the control shaft 10.

The eccentric cam 11 is fixed to the control shaft 10 through a fixing pin 11*a* so that the eccentric cam 11 is rotated according to the rotational motion of the control shaft 10.

The pair of lift arms 30 make contact with a top end of a swing arm 15 provided at a top end of each valve 14 and serve to control a lift amount of a valve.

To this end, a coupling hole 31 is formed at a central portion of the lift arm 30 so that the control shaft 10 is coupled into the coupling hole 31, and a curved surface 32 to control a lift amount of a valve is formed at a bottom surface of the lift arm 30.

A coupling part 33 coupled with the lift arm link 36 is provided at an upper portion of the lift arm 30. A coupling groove 34 may be formed at the coupling part 33 so that a stepped portion of the lift arm link 36 may be coupled with the coupling groove 34.

Coupling holes 35 may be formed at both side walls of the coupling part 33 so that a lift arm axle 39 is coupled with the coupling holes 35.

The adjusting screw 41 and the lift arm axle 39 are rotatably coupled with both ends of the lift arm link to serve to uniformly maintain a distance between the adjusting screw 41 and the lift arm axle 39.

To this end, the lift arm link 36 may be provided at one side thereof with a cylindrical portion 37 coupled to the adjusting screw 41 and at the other side thereof with a stepped portion 38 rotatably coupled with the coupling groove 34 of the lift arm 30.

An axle coupling hole may be formed at the stepped part 38 so that the lift arm axle 39 is coupled with the axle coupling hole.

Meanwhile, although the embodiment has been described that the coupling part 33 is formed at an upper portion of the lift arm 30, and the stepped part 38 is provide at a side of the lift arm link 36 so that the stepped part 38 is coupled with the coupling groove 34 formed at the coupling part 33, the present invention is not limited thereto.

That is, the present invention may be modified in such a manner that the stepped part is formed at an upper portion of the lift arm, and a coupling part having a coupling groove coupled with the stepped part is provided at a side of the lift arm link.

The deviation control part 40 serves to control lift deviation of a valve between cylinders of an engine by controlling a curve surface angle of a lift arm by controlling a coupling angle between the coupling flange 25 of the rocker arm 20 and the lift arm link 36.

To this end, as shown in FIGS. 2 and 3, the deviation control part 40 may include a pair of adjusting screws 41 fastened to an insertion hole 26 and the cylindrical portion 37 of the lift arm link 36 provided at both ends of the rocker arm 20, respectively, and a pair of fixing nuts 42 fastened to a front end of the each adjusting screw 41.

The adjusting screw 41 and the fixing nut 42 serve to fix the coupling flange 25 and the cylindrical portion 37 in a state that a coupling angle between the coupling flange 25 and the lift arm link 26 is controlled.

A control groove 43 may be formed at a head of the adjusting screw 41, and a driver or a dedicated tool is inserted into control groove 41 to adjust a rotating angle of the adjusting screw 41.

Further, scales may be notched in the head of the adjusting screw 41 at a predetermined interval to confirm an adjusting amount when adjusting lift deviation of the valve 114.

A flange 44 is formed at a central portion of each adjusting screw 41. An inner portion and an outer portion of each adjusting screw 41 may have a diameter corresponding to a diameter of an insertion hole 26 of the coupling flange 25 and an inner diameter of the cylindrical portion 37 of the lift arm link 36, respectively.

In this manner, the present invention may control valve lift deviation between cylinders by controlling rotating angles of the rocker arm and the lift arm by controlling a coupling angle between the coupling flange and the lift arm link formed at the rocker arm.

Meanwhile, a pair of return springs 50 may be provided at outer sides of the lift arms 30 to provide a restoring force to the lift arms 30.

Figure 4:
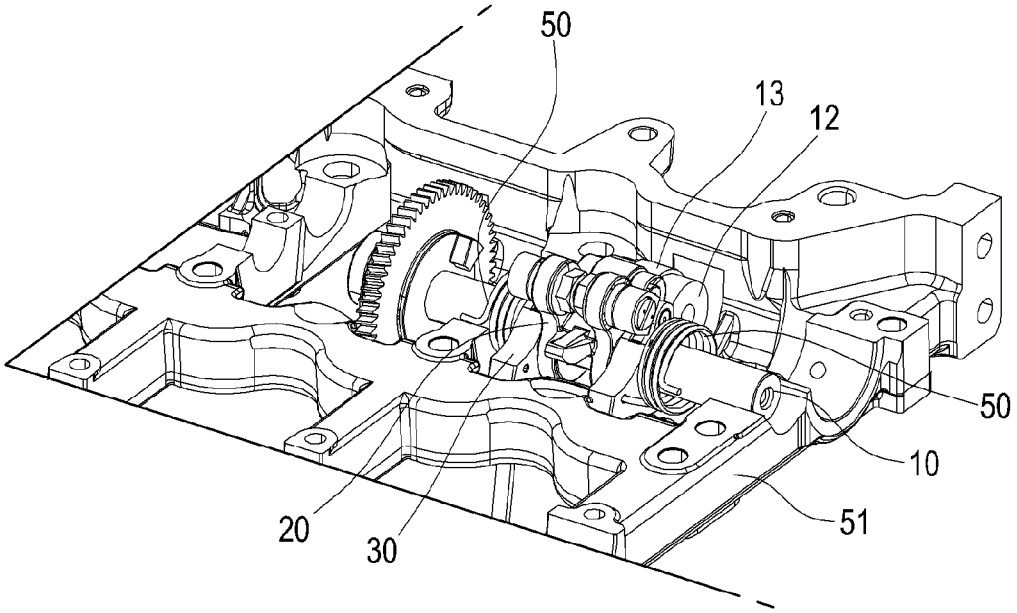
FIG. 4 is a perspective view illustrating a carrier in which the continuously variable valve lift actuator of an engine shown in FIG. 1 is installed.

FIG. 4 is a perspective view illustrating a continuously variable valve lift actuator of an engine shown in FIG. 1.

As shown in FIGS. 1 to 4, each return spring 50 may be provided as a torsion spring to be coupled with both sides of the control shaft 10.

One end of the return spring 50 is fixed to one surface of a carrier 51, on which the continuously variable valve lift actuator of an engine is installed, and another end of the return spring 50 may be coupled with a lift arm 30.

To this end, an insertion hole may be formed at each lift arm 30 so that an end of the return spring 50 is inserted into the insertion hole.

In this manner, in the present invention, the return spring is provided at outer sides of a pair of lift arms to provide a restoring force to the link arm and the rocker arm performing a rotational motion according to rotational motions of the control shaft and the cam shaft, thereby rapidly restoring the link arm and the rocker arm to an original location.

In particular, since a pair of return springs are installed at both sides of the control shaft in the present invention, a carrier component is simplified and a layout between carriers can be easily changed.

The present invention may be modified in such a manner that an installation groove is formed in a top surface of a carrier, and contact projections make contact with the return spring on a front surface of the rocker arm.

Hereinafter a method of operating the continuously variable valve lift actuator of an engine according to an exemplary embodiment of the present invention will be described with reference to FIGS. 5 to 8.

Figure 5:
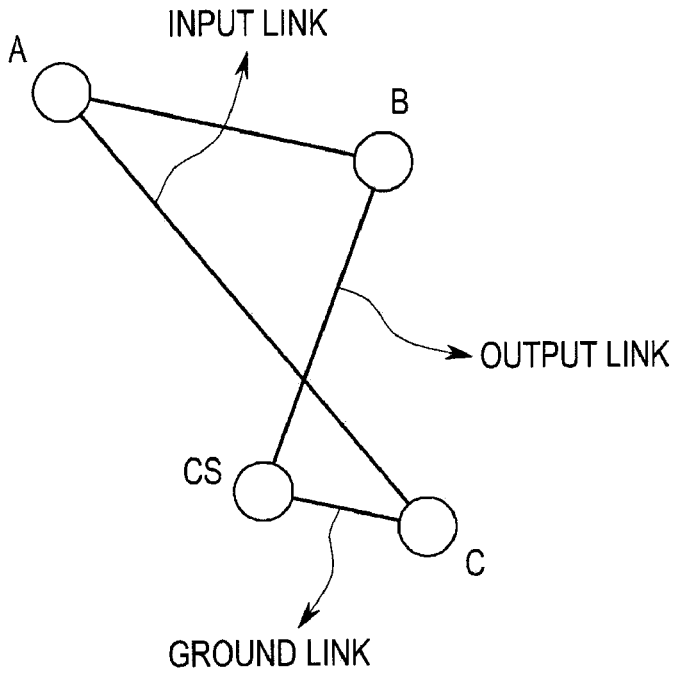
FIGS. 5 and 6 are schematic diagrams to explain an operation method of the continuously variable valve lift actuator of an engine according to an exemplary embodiment of the present invention.
Figure 6:
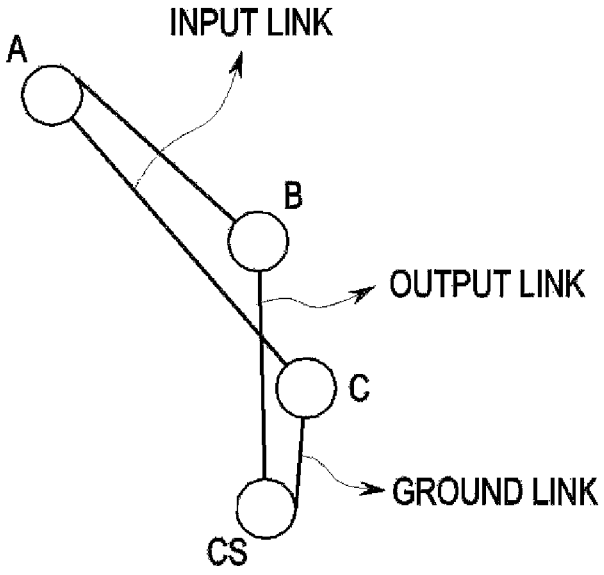
Figure 7:
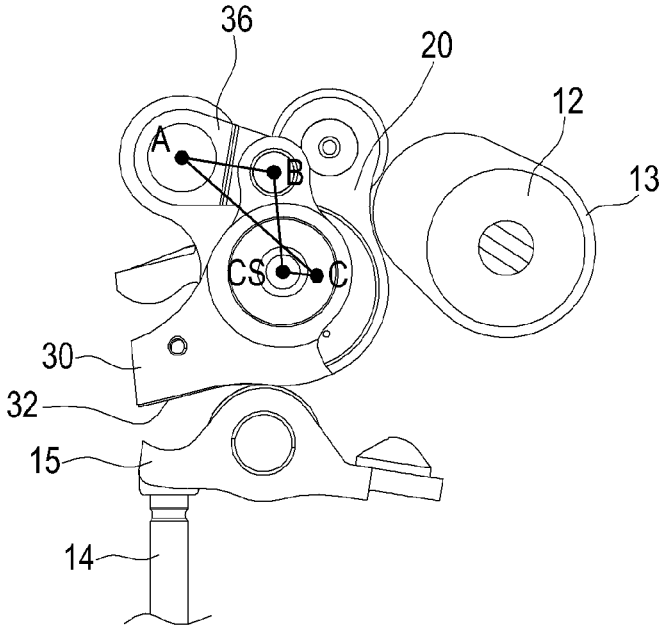
FIGS. 7 and 8 are views showing the operational states to control an intake amount of air by the continuously variable valve lift actuator of an engine according to an exemplary embodiment of the present invention.
Figure 8:
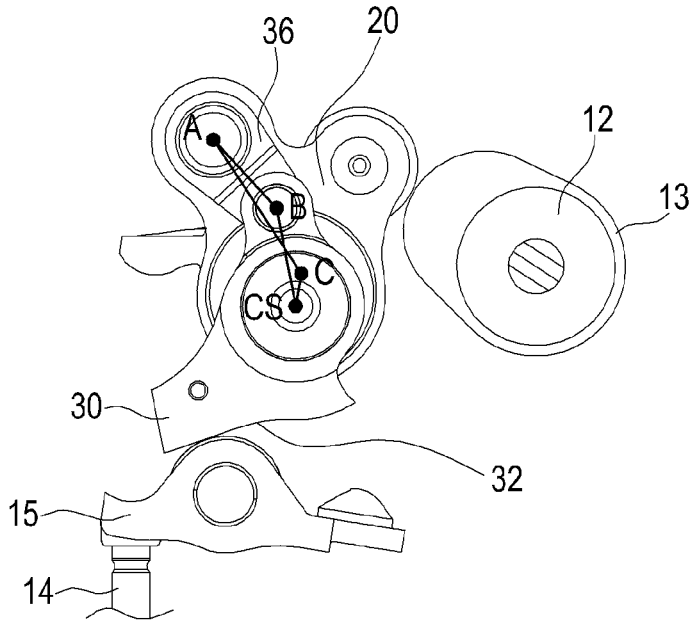

FIGS. 5 and 6 are reference diagrams to describe an operation method of the continuously variable valve lift actuator of an engine according to an exemplary embodiment of the present invention, and FIGS. 7 and 8 are views showing the states of an operation of controlling an intake amount of air by the continuously variable valve lift actuator of an engine according to an exemplary embodiment of the present invention.

The continuously variable valve lift actuator of an engine according to an exemplary embodiment of the present invention has a four-bar link structure as shown in FIGS. 5 and 6.

If the rocker arm 20 and the lift arm link 36 perform a rotational motion according to a rotational motion of the cam shaft 12 serving as an input link A-C, a swing arm 15 performs a seesaw motion upward and downward based on a shaft coupled with a central portion according to a profile shape of a curved surface 32 formed at a bottom surface of the lift arm 30.

Accordingly, a valve 14 opens or closes an air intake port formed at a cylinder head while the valve 14 is pushed at a bottom end of the swing arm 15.

Meanwhile, if the control shaft 10 performs a rotational motion according to engine loads by operational states of the vehicle, the eccentric cam 11 is rotated by a preset angle so that the rocker arm 20, the lift arm link 36, and the lift arm 30 having the four-bar link structure may be moved upward and downward.

That is, upon a low speed operation of the vehicle, as shown in FIG. 7, the rocker arm 20, the lift arm link 36, and the lift arm 30 form a predetermined angle to reduce a rotating angle of the swing arm 15, so a low lift mode reducing an intake amount of air may be implemented.

In addition, upon a high speed operation of the vehicle, as shown in FIG. 8, the rocker arm 20 substantially overlaps with the lift arm link 36 so that a curved surface of the lift arm 30 is rotated and inclined by a predetermined angle. Accordingly, a rotating angle of the swing arm 15 is increased so that a high lift mode where the intake amount of air is increased may be implemented.

Meanwhile, upon designing the continuously variable valve lift actuator of an engine, an advance phenomenon and a delay phenomenon occur according to peripheral environments, that is, a rotating location and a rotating direction of the cam shaft in a state that lift deviation between valves is controlled and the continuously variable valve lift actuator is actually assembled in the engine. That is, if the advance phenomenon occurs, an open time of the valve becomes earlier than a reference time so that a fuel efficiency and an efficiency of the engine can be improved.

In contrast, if the delay phenomenon occurs, the open time of the valve becomes later than the reference time so that the fuel efficiency and the efficiency of the engine are degraded.

Accordingly, according to the embodiment, in order to advance the fuel efficiency and the efficiency of the engine, the open time of the valve is advanced.

FIGS. 9 to 14 are diagrams illustrating an operation to advance an open time of a valve according to a rotating direction of a cam shaft.

Figure 9:
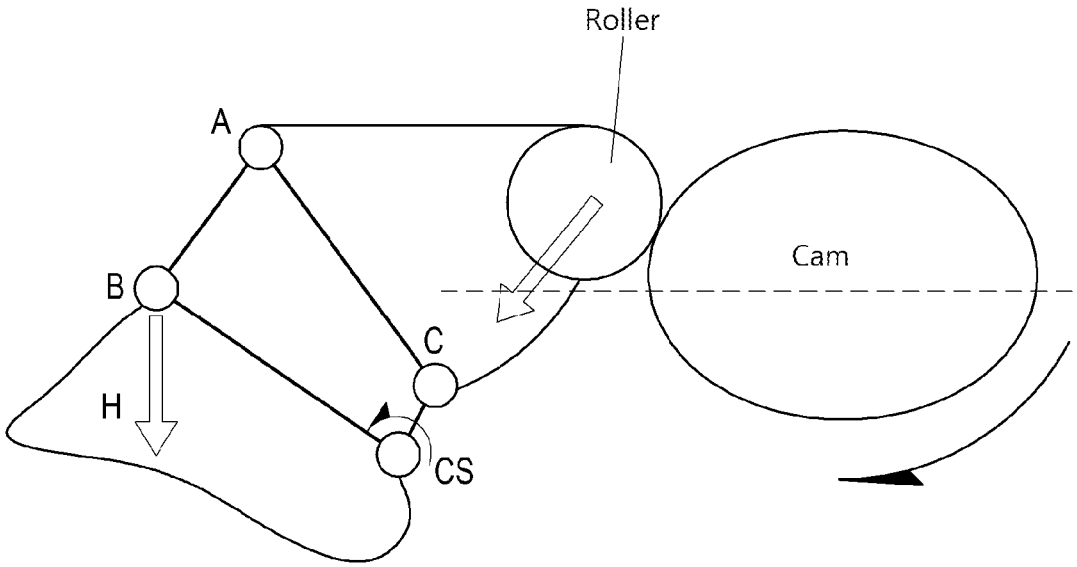
FIGS. 9 to 14 are schematic diagrams illustrating an operation to advance an open time of a valve according to a rotating direction of a cam shaft.

As shown in FIG. 9, when the cam is rotated clockwise in a low lift mode, the control shaft CS-C is rotated counterclockwise based on a fixed point CS so that a position of a point B is moved in an H direction by a mutually connected link.

Accordingly, as the lift arm descends to push the valve, an elevating distance of the valve is increased so that the high lift mode is performed.

In this procedure, a contact point position between a roller and a cam of the rocker arm (A-roller-C) descends based on a center of the cam and an open time becomes earlier, so an advance effect of the high lift mode can be represented.

Figure 10:
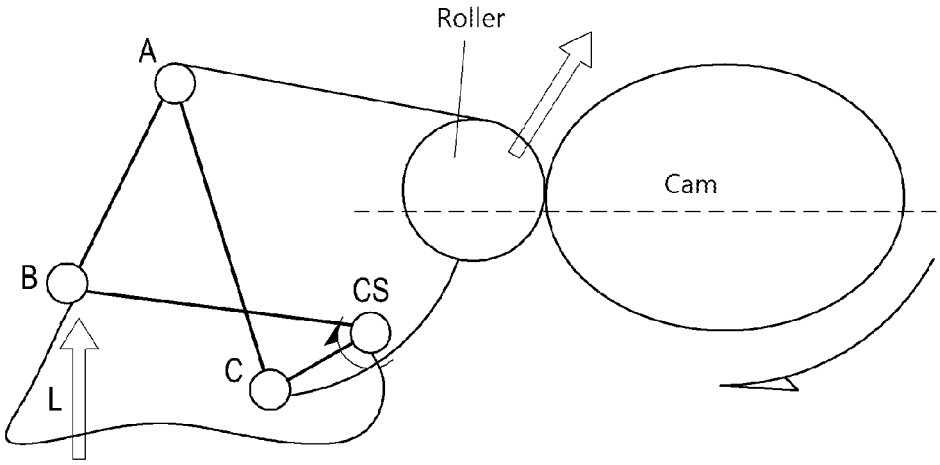

As shown in FIG. 10, when the cam is rotated clockwise in a high lift mode, the control shaft CS-C is rotated clockwise based on the fixed point CS so that a position of the point B is moved in an L direction by a mutually connected link.

Accordingly, as the lift arm ascends to further push the valve, an elevating distance is reduced so that a low lift mode is performed.

In this procedure, as a position of a contact point between the roller and the cam of the rocker arm A-roller-C ascends based on a center of the cam, an open time of the valve is delayed so that a delay effect of the low lift mode may be obtained.

In this manner, the present invention may represent the advance effect in a high lift mode using the four-bar link structure.

Figure 11:
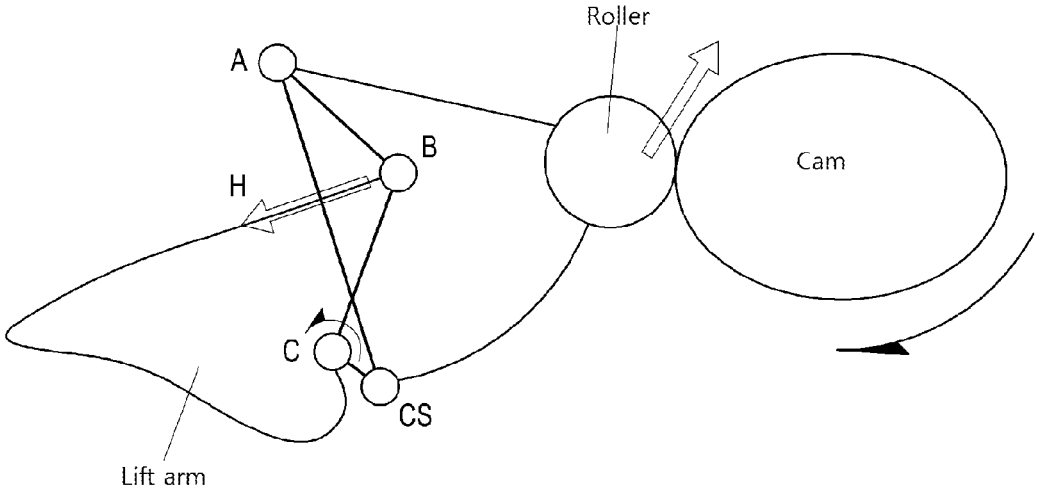
Figure 12:
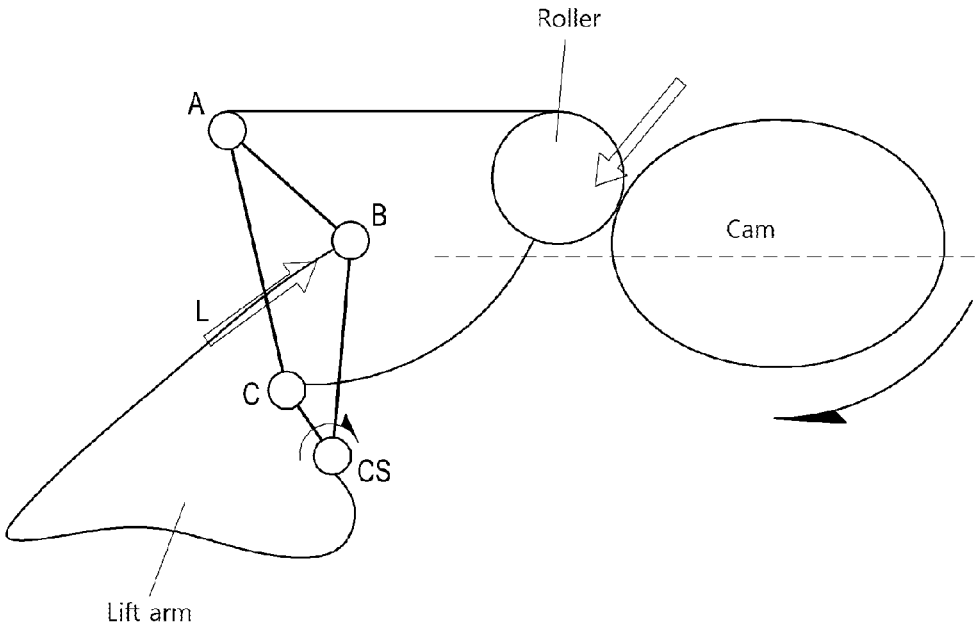

Meanwhile, as shown in FIGS. 11 and 12, the present invention may be modified so that the advance effect can be represented in a low lift mode by changing a position of the point B.

That is, as shown in FIG. 11, when the cam is rotated clockwise in the low lift mode where a position of the point B is changed, the control shaft CS-C is rotated counterclockwise based on the fixed point CS so that the position of the point B is moved in an H direction by a mutually connected link.

Accordingly, as the lift arm descends to further push the valve, an elevating distance is increased so that the high lift mode is performed.

In this procedure, since a position of the contact point between the roller and the cam of the rocker arm A-roller-C ascends based on a center of the cam so that the open time of the valve is delayed, the delay effect of the high lift mode may be represented.

Further, as shown in FIG. 12, when the cam is rotated clockwise in the high lift mode where the position of the point B is changed, the control shaft CS-C is rotated clockwise based on a fixed point CS so that the position of the point B is moved in an L direction by a manually connected link.

Accordingly, the lift arm ascends to further push the valve so that the low lift mode is performed.

In this procedure, the position of a contact point between the roller and the cam of the rocker arm A-roller-C descends based on a center of the cam so that an open time of the valve is advanced, thereby representing the advance effect in the low lift mode.

In this manner, the present invention can change the position of the point B in the continuously variable valve lift actuator of an engine having a four-bar link structure to represent the advance effect in the high lift mode or the low lift mode.

Figure 13:
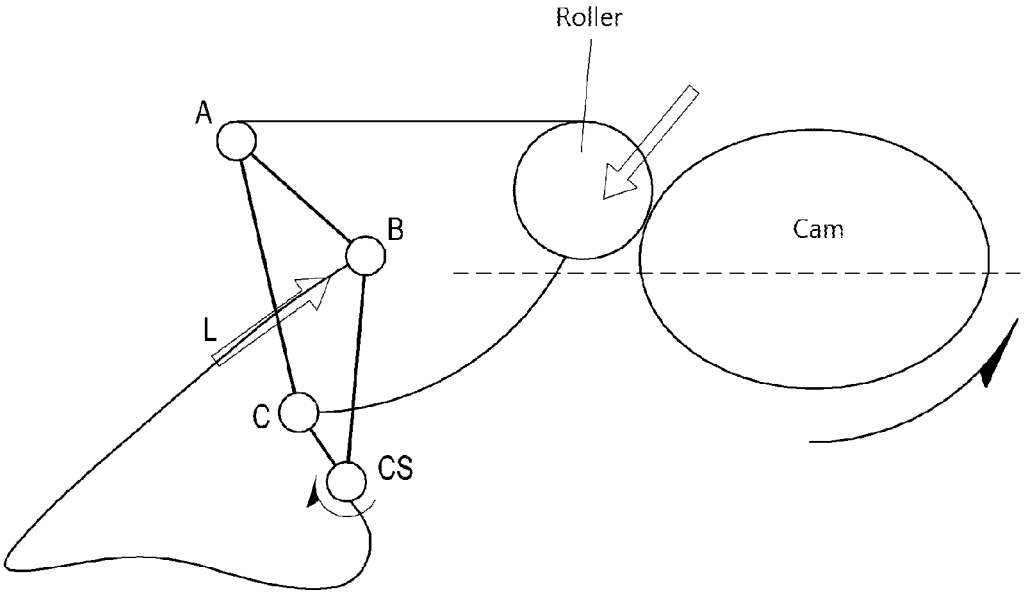

Further, as shown in FIG. 13, when the cam is rotated counterclockwise in the high lift mode, the advance effect upon a clockwise rotation of FIG. 9 and the low lift mode in an opposite direction may be represented by changing a point C and a point CS.

Figure 14:
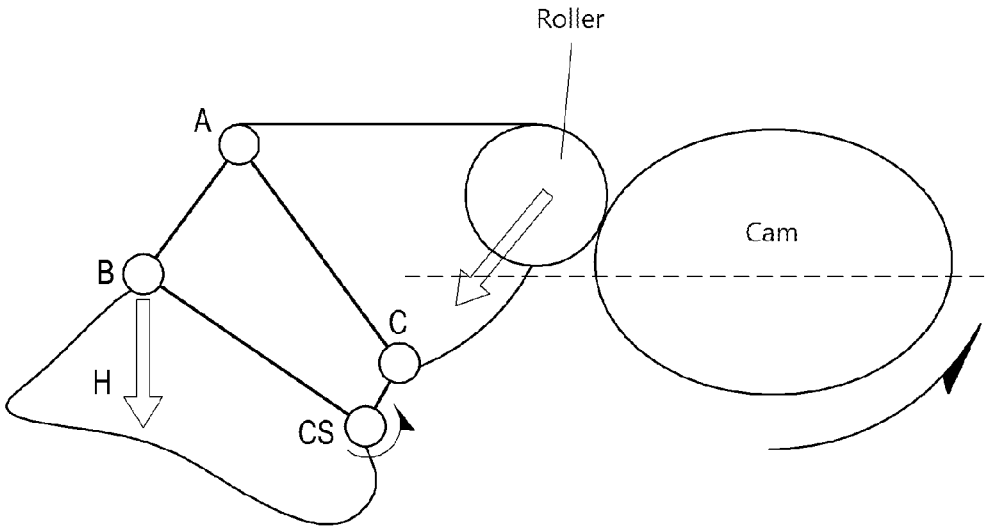

In addition, as shown in FIG. 14, when the cam is rotated counterclockwise in the lower lift mode, the advance effect in the high lift mode may be represented by changing the position of the point B.

In this manner, the present invention is applied to various engines by controlling a location and a length of a link bar according to a rotating direction of a cam shaft to an intake valve of the engine and interference of a layout of the engine to obtain the advance effect of an open time of the valve in the high lift mode or the low lift mode.

Figure 15A:
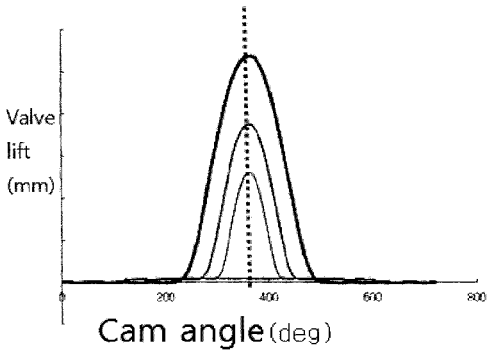
FIG. 15A is a graph illustrating valve lifts of the continuously variable valve lift actuator of an engine and the valve lift actuator according to the related art.
Figure 15B:
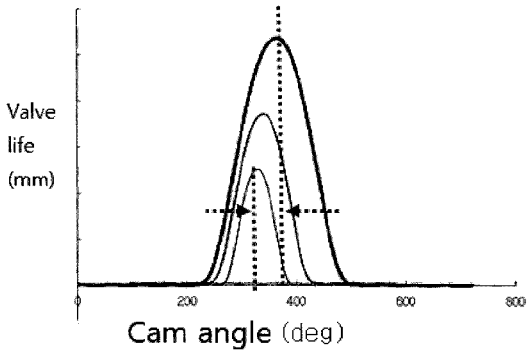
FIG. 15B is a graph illustrating valve lifts of the continuously variable valve lift actuator of an engine and the valve lift actuator according to the present invention.

FIG. 15A is a graph illustrating valve lifts of the continuously variable valve lift actuator of an engine and the valve lift actuator according to the related art, and FIG. 15B is a graph illustrating valve lifts of the continuously variable valve lift actuator of an engine and the valve lift actuator according to the present invention.

In the continuously variable valve lift actuator of an engine according to the related art, the same valve lift center is present in a valve lift graph shown in FIG. 15A.

In contrast, in the continuously variable valve lift actuator of an engine according to the present invention, a center of the low lift can be advanced in the graph of the valve lift as shown in FIG. 15B.

Through the above procedure, the present invention can control the intake amount of air to reduce pumping loss and advance the open time of the valve to improve an efficiency and a fuel efficiency of the engine by changing an elevating distance of the intake valve installed at an input port of a cylinder according to operational states of the vehicle.

The present invention is not limited to the above-described embodiment, and may be variously modified by those skilled in the art to which the present invention pertains without departing from the spirit of the present invention and the modification falls within the scope of the present invention.

The present invention can be applied to a technology which controls the intake amount of air to reduce pumping loss by changing an elevating distance of an intake valve installed at an input port of the cylinder according to a running state of the vehicle, and improves the efficiency and the fuel efficiency of the engine by advancing the open time of the valve.

What is claimed is:

1. A continuously variable valve lift actuator of an engine, comprising:

a rocker arm;

a lift arm having a four-bar link structure to control an intake amount of air of an intake valve based on a running state of a vehicle;

a link bar;

a cam coupled to a cam shaft; and a pair of eccentric cams coupled to a control shaft, wherein the valve lift actuator is configured to change rotating angles of the rocker arm and the lift arm, and adjust a location and a length of the link bar by taking into consideration a rotating direction of the cam shaft and interference according to a layout of the engine to advance an open time of the intake valve, wherein the rocker arm is rotated within a preset angle range according to a rotational motion of the pair of eccentric cams coupled to the control shaft and a rotation motion of the cam coupled to the cam shaft, and the lift arm having one side coupled to the control shaft is rotated within the preset angle range, wherein a pair of flanges and a pair of coupling flanges spaced apart from each flange by a predetermined angle are disposed at both ends of the rocker arm in a direction perpendicular to a direction of a central axis of the rocker arm, respectively, and wherein one of the coupling flanges and the lift arm are rotatably connected to each other by one of lift arm links.

2. The continuously variable valve lift actuator of claim 1, further comprising a deviation control part to control lift deviation between valves by controlling the rotating angles of the rocker arm and the lift arm, wherein the deviation control part comprises a pair of adjusting screws coupled with an insertion hole of each coupling flange and a cylindrical portion of the lift arm link disposed at both ends of the rocker arm, respectively, and a pair of fixing nuts fastened to a front end of each adjusting screw.

3. The continuously variable valve lift actuator of claim 1, wherein coupling holes are formed at centers of the coupling flanges, respectively, and a rocker arm axle is coupled in the coupling holes, the rocker arm axle is coupled into the coupling holes of each coupling flange formed at both ends of the rocker arm by passing through the coupling holes, a bearing making contact with the cam is coupled with a central portion of the rocker arm axle, a coupling hole is located at a central portion of the lift arm so that the control shaft is coupled into the coupling hole of the lift arm, and a curved surface to control a lift amount of the intake valve is formed at a bottom surface of the lift arm.

4. The continuously variable valve lift actuator of claim 3, further comprising a deviation control part to control lift deviation between valves by controlling the rotating angles of the rocker arm and the lift arm, wherein the deviation control part comprises a pair of adjusting screws coupled with an insertion hole of each coupling flange and a cylindrical portion of the lift arm link disposed at both ends of the rocker arm, respectively, and a pair of fixing nuts fastened to a front end of each adjusting screw.

5. The continuously variable valve lift actuator of claim 4, wherein a return spring is disposed adjacent to the lift arm on the control shaft to provide a restoring force to the lift arm.

6. The continuously variable valve lift actuator of claim 4, wherein a contact projection is disposed at a front surface of the lift arm, and a return spring making contact with a lower portion of the contact projection is disposed at a carrier, on which the continuously variable valve lift actuator of the engine is installed, to provide the restoring force to the lift arm.

7. The continuously variable valve lift actuator of claim 4, wherein a control groove is located at a head of each adjusting screw and configured such a way that a tool can be inserted into the control groove to adjust a rotating angle of the adjusting screw, and scales are notched in the head of the adjusting screw at a predetermined interval to confirm an adjusting amount when adjusting the lift deviation of the intake valve.

8. The continuously variable valve lift actuator of claim 1, wherein, when the cam is rotated clockwise in a high lift mode, the control shaft is rotated clockwise to ascend the lift arm so that the high lift mode is switched to a low lift mode, and a position of a contact point between a roller of the rocker arm and a cam descends based on a center of the cam so that an advance effect is presented.

* * * * *